US008327484B2

(12) United States Patent
Wolf et al.

(10) Patent No.: US 8,327,484 B2
(45) Date of Patent: Dec. 11, 2012

(54) METHOD FOR SMOOTHING ARTICLES OF CLOTHING AND TUNNEL FINISHER

(75) Inventors: Jurgen Wolf, Herford (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 0 days.

(21) Appl. No.: 13/088,386

(22) Filed: Apr. 17, 2011

(65) Prior Publication Data

US 2011/0252674 A1 Oct. 20, 2011

Related U.S. Application Data

(62) Division of application No. 11/836,191, filed on Aug. 9, 2007, now Pat. No. 7,966,682.

(30) Foreign Application Priority Data

Aug. 14, 2006 (DE) ..... 10 2006 038 095
Oct. 24, 2006 (DE) ..... 10 2006 050 015

(51) Int. Cl.
*D06B 1/02* (2006.01)

(52) U.S. Cl. ..... 8/149.1

(58) Field of Classification Search ..... 8/149.1; 68/5 C, 5 D

See application file for complete search history.

(56) References Cited

U.S. PATENT DOCUMENTS 1,976,453 A * 10/1934 Morken ..... 223/51
2,729,844 A * 1/1956 Weiss ..... 15/308
3,415,352 A * 12/1968 Gerisch ..... 198/359
3,770,148 A * 11/1973 Hendren ..... 414/287
3,927,539 A * 12/1975 Harkison ..... 68/3 R
4,018,327 A * 4/1977 Goodman et al. ..... 198/723
4,070,876 A * 1/1978 Thompson et al. ..... 68/3 R
4,300,366 A * 11/1981 Barrett ..... 68/3 R
4,519,222 A * 5/1985 Kannegiesser et al. ..... 68/5 C
4,756,934 A * 7/1988 Ukawa ..... 427/394
4,878,336 A * 11/1989 Kohler ..... 53/500
2003/0066138 A1 * 4/2003 France et al. ..... 8/147

FOREIGN PATENT DOCUMENTS

JP 04-084998 * 3/1992
JP 06-335599 * 12/1994

* cited by examiner

*Primary Examiner* — Frankie L Stinson
(74) *Attorney, Agent, or Firm* — Laurence P. Colton; Smith Risley Tempel Santos LLC

(57) ABSTRACT

A tunnel finisher in which the articles of clothing (14) are impinged on with steam pulses in a discontinuous fashion. This lowers the steam requirement. It is additionally provided that other points of the article of clothing (14) are continuously impinged on with steam, as a result of which no damage to the articles of clothing (14) occurs during the steam impingement. It is finally provided that transport hangers (15), on which the articles of clothing (14) hang while being transported through the tunnel finisher, are rotated in opposite directions, as a result of which halves of adjacent articles of clothing (14) alternately assume relatively large and relatively small spacings relative to one another. In this way, the articles of clothing (14) can be impinged on effectively and with steam.

8 Claims, 12 Drawing Sheets

METHOD FOR SMOOTHING ARTICLES OF CLOTHING AND TUNNEL FINISHER

STATEMENT OF RELATED APPLICATIONS

This patent application is a division of U.S. patent application Ser. No. 11/836,191 having a filing date of 9 Aug. 2007, currently pending and allowed, which is based on and claims priority on German patent application no. 10 2006 038 095.9 having a filing date of 14 Aug. 2006 and German patent application no. 10 2006 050 015.6 having a filing date of 24 Oct. 2006, all of which are incorporated herein by this reference in their entireties.

BACKGROUND OF THE INVENTION

1. Technical Field

The invention relates to a method for smoothing articles of clothing in a tunnel finisher, with the articles of clothing being transported in the transport direction longitudinally through a treatment chamber of the tunnel finisher and being sprayed with steam. The invention also relates to tunnel finishers for smoothing articles of clothing, having a treatment chamber through which articles of clothing which hang down from transport hangers can be transported by a conveyer in the transport direction, and having steam outlet openings arranged in the treatment chamber.

2. Related Art

Tunnel finishers serve to smooth articles of clothing with steam and/or hot air. The articles of clothing are preferably transported continuously through the tunnel finisher while hanging on transport hangers.

In known tunnel finishers, problems have occurred in the steam impingement of the articles of clothing. For example, the articles of clothing have been damaged or the articles of clothing have not been uniformly impinged on with steam. A further problem has proven to be the adaptation of the steam quantity to the different articles of clothing, in particular when articles of clothing made from different materials are transported through the tunnel finisher in a mixed fashion.

BRIEF SUMMARY OF THE INVENTION

The invention is based on the object of creating methods for smoothing articles of clothing and tunnel finishers which create a good finished result even in the case of different articles of clothing and which treat the articles of clothing in a gentle fashion.

One method for achieving said object is a method for smoothing articles of clothing in a tunnel finisher, with the articles of clothing being transported in the transport direction longitudinally through a treatment chamber of the tunnel finisher and being sprayed with steam, wherein the articles of clothing in the tunnel finisher are impinged on with steam in a discontinuous fashion. According to this method, it is provided that the articles of clothing in the tunnel finisher are impinged on with steam in a discontinuous fashion. According to the invention, there is therefore a pulsed steam supply to the articles of clothing, by virtue of steam not being continuously discharged out of the steam outlet openings. This leads primarily to the steam being conducted more effectively to the articles of clothing. In addition, the steam requirement can be reduced by means of the discontinuous steam supply.

The discontinuous steam supply is particularly effective when steam nozzles are used for the steam discharge. In this way, the articles of laundry are impinged on with steam pulses, which leads to effective and uniform contact of the articles of clothing with the spray steam.

The articles of clothing are preferably impinged on with short steam pulses or steam surges which are successive in terms of time. The impulse of the steam pulses or steam surges from in particular steam nozzles leads to the steam flowing largely uniformly past the articles of clothing. Between the individual steam surges or steam pulses, the steam supply or the steam discharge to or from the respective steam outlet opening, in particular steam nozzle, is interrupted. This leads very particularly to a reduction in the steam consumption.

In one preferred embodiment of the method, the steam impingement of the articles of clothing takes place by means of a plurality of groups of steam outlet openings or steam nozzles. Steam is then discharged simultaneously from the steam outlet openings or steam nozzles of a group, with steam being discharged from the steam outlet openings or steam nozzles of other groups at a different time. Steam is therefore discharged from the different groups of steam outlet openings or nozzles in succession. The steam outlet openings or steam nozzles of a group can be adjacent to one another, so that a steam impingement of the articles of clothing always takes place at a certain point of the treatment chamber. It is however also conceivable to arrange the steam outlet openings or nozzles of each group so as to be distributed in the treatment chamber, so that an impingement of the articles of clothing with steam takes place instantaneously distributed over the entire spray steam zone of the treatment chamber of the tunnel finisher, but in each case at different points.

A further method for achieving the object specified in the introduction, which can also be a preferred refinement of the above-described method, is a method for smoothing articles of clothing in a tunnel finisher, with the articles of clothing being transported in the transport direction longitudinally through a treatment chamber of the tunnel finisher and being sprayed with steam, wherein the articles of clothing are impinged on with steam at alternating points while passing through that part of the treatment chamber in which steam impingement of the articles of clothing takes place. According to this method, it is provided that the articles of clothing are impinged on with steam at alternating points while passing through that part of the treatment chamber in which the articles of clothing are impinged on with steam, the so-called spray steam zone.

It is preferably provided that the articles of laundry are not impinged on with steam continuously at the same point while passing through the spray steam zone. This leads not only to a steam supply which is distributed with respect to the articles of clothing; the articles of laundry are also treated with care. In the case in particular of the pulsed, discontinuous steam supply to the articles of clothing, it is advantageous if the steam surges or pulses do not always impact against the same point of the article of clothing, but against different points.

It is additionally provided that the articles of laundry are impinged on with steam at hard to reach points, in particular the crotch of articles of clothing which have legs, primarily dungarees and overalls, or under the armpits of articles of clothing which have sleeves, such as blouses, jackets or the like. Said points are preferably impinged on with steam in addition to the usual points. The steam impingement in the region of the crotch or the armpits can take place continuously. The articles of clothing are preferably also impinged on with steam in a pulsed or discontinuous fashion in the region of the crotch and/or the armpits. As a result of the additional steam impingement of critical points such as the crotch of trousers and overalls and the armpits of blouses and jackets, said critical regions dry out not only faster but also more reliably. This leads to a reduced spray steam consumption. In the case of trousers, the additional steam impingement in the crotch region also leads to better drying of pockets, in particular back pockets.

The spraying of the crotch region of for example dungarees and overalls and of the armpit region of blouses and the like takes place by means of tubes arranged at corresponding points of the treatment chamber. The tubes are preferably fixedly arranged in the treatment chamber, specifically so as to run in the longitudinal direction thereof. The steam can be supplied to the articles of clothing from simple steam outlet bores or else steam outlet nozzles. The tubes are arranged in the treatment chamber in such a way that the tubes for trousers are not disruptive in the treatment of blouses or the like, and conversely, the tubes for the blouses, shirts or the like are not disruptive in the treatment of trousers or the like. For example, the tubes for the steam impingement of the crotch of trousers or the like are arranged in the treatment chamber in such a way that they lie below blouses. The tubes for the steam impingement of the armpits of blouses, shirts or the like are arranged in such a way that dungarees or some other trousers can be transported between them substantially unhindered.

It is however also conceivable for the tubes for the additional steam impingement of critical regions of articles of clothing such as the armpit regions and crotch regions to be arranged in the treatment chambers so as to be moveable in terms of position. This is expedient primarily if only trousers, blouses or other types of articles of clothing are treated in batches. The tubes for the steam impingement of the armpit regions of blouses are then moved to the side during the treatment of trousers, in such a way that the tubes are not disruptive in the treatment of trousers. A converse approach is taken with the tubes for the additional steam treatment of the crotch of trousers.

A further method for achieving the object specified in the introduction, which can also be preferred refinements of the above-described method, is a method for smoothing articles of clothing in a tunnel finisher, with the articles of clothing being transported in the transport direction longitudinally through a treatment chamber of the tunnel finisher and being sprayed with steam, wherein the spacing between adjacent articles of clothing is at least partially enlarged at times. As a result of it being provided according to the invention that the spacing between articles of clothing, which are arranged in succession in and transversely with respect to the direction of transport, is at least partially enlarged at times, the spacings between the articles of clothing, which follow one another with their flat sides, continuously vary while said articles of clothing are transported through the treatment chamber, in particular the spray steam zone. The spacing preferably between halves of the adjacent flat sides of successive articles of clothing is alternately decreased and increased in size, as a result of which the halves of the flat sides of adjacent articles of clothing have a relatively large spacing with respect to one another at times and are situated tightly against one another at times. In this way, the steam, in particular pulsed steam, can pass better between the articles of clothing, as a result of which said articles of clothing can be treated effectively and above all more uniformly.

The transport hangers with the articles of clothing hanging thereon are preferably rotated in opposite directions about a vertical central axis, which preferably runs through a hanger hook of the respective transport hanger, in a continuous or else discontinuous fashion at least while passing through the spray steam zone. In this way, a type of twisting motion of the transport hanger, with the article of clothing hanging thereon in each case, takes place. In this way, the respective article of clothing is also rotated about a vertical central axis. The transport hangers with the articles of clothing are alternately rotated in opposite directions, as a result of which adjacent transport hangers with articles of clothing obtain, as viewed from above, an antiparallel, approximately V-shaped alignment. While the upright edges of adjacent articles of clothing and ends of adjacent transport hangers lie more tightly together on one side of the vertical longitudinal central axis of said transport hanger, the upright edges of adjacent articles of clothing and ends of the transport hangers obtain a relatively large spacing on the other side of the vertical longitudinal central axis. As a result of the rotation, in pairs, of adjacent transport hangers with articles of clothing hanging thereon in opposite directions, the spacings of the articles of clothing on one side of the vertical central axes increase and decrease in size at regular time intervals. This results practically in a constant back-and-forth pivoting motion of the articles of clothing about the vertical central axes, with the spacings between adjacent articles of clothing being larger or smaller once on the one side and once on the other side of the central axes. This makes intensive steam impingement of the articles of clothing in the spray steam zone possible. This leads to effective finishing with the lowest possible steam requirement.

The rotation of the transport hangers with the articles of clothing hanging thereon about the vertical central axis in opposite directions can take place both mechanically and also aerodynamically, in particular pneumatically. The rotation of the transport hangers and of the articles of clothing preferably takes place both mechanically and aerodynamically. In this way, the transport hangers with the articles of clothing hanging thereon can be rotated about their vertical central axes in a targeted fashion, so that a reliable, uniform sequence of differently-rotated transport hangers with articles of clothing is generated, as a result of which the articles of clothing are reliably moved apart and together again on one side of the vertical central axis, specifically according to a targeted pattern. This ensures that spray steam can pass between all of the articles of clothing. An uncontrolled, random pivoting or twisting motion of the articles of clothing about their vertical central axis, which could lead to non-uniform steam impingement of the articles of clothing and if appropriate to damage thereof, is thus reliably avoided as a result of the method according to the invention.

A further method for achieving the object specified in the introduction, which can also be a preferred refinement of the above-described method, is characterized by a method for smoothing articles of clothing in a tunnel finisher, with the articles of clothing being transported in the transport direction longitudinally through a treatment chamber of the tunnel finisher and being sprayed with steam, wherein the size and/or the weight of the individual articles of clothing are/is determined before the start of the finishing treatment. According to this method, it is provided that the size and/or the weight of the individual articles of clothing are/is determined before the start of the finishing treatment. This is expedient in particular if different articles of clothing, primarily articles of clothing made from different materials, are transported through the tunnel finisher in succession. The treatment can then be largely adapted to the respective article of clothing, which can then be finished corresponding to its type. It is primarily possible for the steam impingement to be controlled according to requirements on the basis of the previously determined weight and/or size of the respective article of laundry.

The size and/or the weight of the respective article of clothing together with the transport hanger on which the article of clothing is situated are preferably determined. Since the weight of the transport hanger is known, it is possible to reliably determine the weight of each individual article of clothing without the latter having to be removed from the respective transport hanger. The determination of the weight and/or of the size of the respective article of clothing expediently takes place before the finishing treatment, specifically at the entry into the tunnel finisher. The start of the entry chamber of the tunnel finisher is particularly suitable for this purpose.

It is also provided that the weight and/or the size of the respective article of clothing is determined while the latter is briefly at a standstill. In this way, it is possible for the desired measurements to be carried out simply and above all reliably. For weighing, the article of clothing with the transport hanger is expediently unhooked from a carrying hook of a conveyer for transporting the transport hanger with the article of clothing through the tunnel finisher. In this way, the size determination and/or the weighing of the article of laundry can take place simply while the article of laundry is at a standstill. For this purpose, the transport hanger with the article of laundry is for a short time hooked onto a weighing device after being unhooked from the conveyer. After the stationary weighing device has weighed the article of clothing with the transport hanger, the transport hanger and the article of clothing are hooked back onto the carrying hook from which they were previously decoupled, and are conveyed onward by the conveyer. The size determination of the article of clothing can take place according to the same principle for example by means of scanning, by virtue of the latter also taking place when the article of clothing is at a standstill when the latter has been briefly unhooked from the conveyer which runs continuously onward during the size determination.

A tunnel finisher for achieving the object specified in the introduction is a tunnel finisher for smoothing articles of clothing, having a treatment chamber through which articles of clothing which hang down from transport hangers can be transported by a conveyer in the transport direction, and having steam outlet openings arranged in the treatment chamber, wherein the steam outlet openings can be periodically impinged on with steam. The tunnel finisher has steam outlet openings which are preferably embodied as steam outlet nozzles. In addition, the tunnel finisher is designed such that the steam outlet openings can be only periodically impinged on with steam.

As a result of the discharge of the steam from openings only at times, and the periodic steam impingement of the steam outlet openings, brief steam surges or pulses are generated. In this way, the articles of clothing are impinged on with steam in a pulsed manner, which has proven to be very effective and leads to a reduction in the steam requirement in relation to known tunnel finishers with a continuous steam impingement of the articles of clothing in the spray steam zone.

The steam outlet openings are assigned a steam supply which makes it possible to control the steam discharge from the steam outlet openings in a targeted fashion, by virtue of individual steam outlet openings or groups of steam outlet openings being impinged on with steam at times, while the other steam outlet openings or groups of steam outlet openings remain closed. Said steam outlet openings or groups of steam outlet openings discharge steam at a different time, when the steam outlet openings previously used for steam discharge are closed. In this way, it is possible for steam to be supplied to the articles of clothing in a targeted fashion to alternating points of the spray steam zone.

A further tunnel finisher for achieving the object stated in the introduction, which can also be a preferred refinement of the above-described tunnel finisher, is a tunnel finisher for smoothing articles of clothing, having a treatment chamber through which articles of clothing which hang down from transport hangers can be transported by a conveyer in the transport direction, and having steam outlet openings arranged in the treatment chamber, wherein the steam outlet openings are arranged with spacings which vary in the transport direction with respect to a vertical longitudinal central plane, which runs in the transport direction, of the treatment chamber. According to this embodiment, the steam outlet openings are arranged with spacings which vary in the transport direction with respect to a vertical longitudinal central axis, which runs in the transport direction, of the treatment chamber. In this way, the steam jets or steam pulses impact at different points against the articles of clothing. This leads to a better distribution of the steam on the articles of clothing. Above all, however, the articles of clothing are damaged to a lesser extent than if the steam were to always impact against the same points of the articles of clothing.

The steam outlet openings are conventionally arranged in at least one row of steam outlet openings which are preferably arranged in succession with equal spacings. In each case at least one row of steam outlet openings which are arranged in succession with spacing is preferably arranged on opposite sides of the vertical longitudinal central axis of the treatment chamber or of the spray steam zone. Said rows, which are conventionally rectilinear, preferably run antiparallel with respect to the longitudinal central axis of the treatment chamber. In this way, the steam from successive steam outlet openings of the individual rows always impacts against different points of an article of clothing. The rows on different sides of the longitudinal central plane or longitudinal central axis of the treatment chamber can run parallel to one another but slightly inclined with respect to the longitudinal central axis, or else can run so as to diverge or converge in the transport direction. It is also conceivable for the steam outlet openings to be arranged in an irregular fashion below the roof in the spray steam zone of the tunnel finisher in particular, with it then however being necessary to ensure that the spacings of the steam outlet openings with respect to the longitudinal central plane of the spray steam zone are different.

A further tunnel finisher for achieving the object stated in the introduction, which can also be a refinement of the above-described tunnel finisher, is a tunnel finisher for smoothing articles of clothing, having a treatment chamber through which articles of clothing which hang down from transport hangers can be transported by a conveyer in the transport direction, and having steam outlet openings arranged in the treatment chamber, wherein the steam outlet openings are arranged in rows on opposite sides of a vertical longitudinal central plane of the treatment chamber, with the steam outlet openings on the one side of the longitudinal central plane in the transport direction being offset with respect to the steam outlet openings on the opposite side of the vertical longitudinal central plane. According to this embodiment it is provided that the steam outlet openings are arranged in rows on opposite sides of a longitudinal central axis of the treatment chamber, with the steam outlet openings on the one side of the longitudinal central axis in the transport direction being offset with respect to the steam outlet openings on the other side of the longitudinal central axis. The steam outlet openings on the one side are therefore arranged in the gaps with respect to the steam outlet openings of the opposite side. The result is that the steam outlet openings which are conventionally fastened under the roof of the tunnel finisher always impact from above on in each case one side of a transport hanger with the article of clothing hanging thereon, and in this way, said transport hanger with the article of clothing is rotated slightly, so that the transport hangers with the article of clothing are aligned not precisely transversely with respect to the transport direction. As a result of the offset of the steam outlet openings on the one side with respect to the steam outlet openings of the other side of the longitudinal central axis, an opposing rotation of the transport hangers with the articles of clothing is generated, so that in each case two adjacent transport hangers on one side of the longitudinal central axis have a smaller spacing than on the opposite side. This results in a so-called hanger twist, which leads to the temporary enlargement of the spacing of the halves of adjacent transport hangers and articles of clothing. The steam can flow in more effectively between those halves of the articles of clothing which have the larger spacings, for more effective finishing of the articles of clothing.

The spacings of adjacent steam outlet openings of all the rows on both sides of the longitudinal central axes of the treatment chamber are preferably of approximately the same size. The steam outlet openings on one side of the longitudinal central axis are then offset with respect to the steam outlet openings on the other side of the longitudinal central axis by half of the spacing between successive steam outlet openings. The spacing of all of the steam outlet openings is preferably double the spacing of the carrying hooks for the transport hangers. Said mean and regular offset of the steam outlet openings on opposite sides of the longitudinal central axis leads to a particularly precise and uniform opposite rotation of the successive transport hangers, so that, on each side of the longitudinal central axis, articles of clothing which have a small spacing and articles of clothing which have a relatively large spacing follow one another regularly, and the transport hangers are rotated in opposite directions at uniform spacings in such a way that the successive, less spaced-apart halves of the articles of clothing obtain a relatively large spacing. Periodic spacing changes of the articles of clothing therefore take place uniformly on opposite sides of the vertical of the longitudinal central plane, in particular of the spray steam zone, as a result of which it is ensured that the entire articles of clothing are uniformly impinged on with steam from the steam outlet openings.

A further tunnel finisher for achieving the object stated in the introduction, which can also be a preferred refinement of the above-described tunnel finisher, is a tunnel finisher for smoothing articles of clothing, having a treatment chamber through which articles of clothing which hang down from transport hangers can be transported by a conveyer in the transport direction, and having steam outlet openings arranged in the treatment chamber, wherein the conveyer has carrying hooks, which are spaced apart from one another, for holding in each case one transport hanger, and the carrying hooks can be rotated independently of one another in alternating directions while being transported through at least the treatment chamber. According to this embodiment, carrying hooks, which hold the transport hangers, of a conveyer for transporting the transport hangers with the articles of clothing through the treatment chamber can be alternately rotated in opposite directions about upright rotational axes while being transported through the treatment chamber. This results in a targeted inclined position of the transport hangers relative to a direction running transversely with respect to the transport direction of the conveyer. In this way, the transport hangers with the articles of clothing hanging thereon are rotated mechanically.

The successive carrying hooks can preferably be rotated in alternating directions, specifically expediently by approximately the same angle. Successive carrying hooks can therefore be rotated to the same degree but in different directions with respect to a plane which runs transversely with respect to the transport direction.

In one preferred embodiment of the tunnel finisher, each carrying hook is assigned a guide pin which engages into a positionally fixed track above the conveyer. Said track moves the guide pin of each carrying hook to a greater or lesser degree out of the longitudinal central plane of the treatment chamber, specifically alternately in different directions, as a result of which the respective carrying hook, and therefore the transport hanger which is hanging thereon with an article of clothing, is rotated positively about the vertical rotational axis of the support hook.

A further tunnel finisher for achieving the object stated in the introduction, which can also be a preferred refinement of the above-described tunnel finisher, is a tunnel finisher for smoothing articles of clothing, having a treatment chamber through which articles of clothing which hang down from transport hangers can be transported by a conveyer in the transport direction, and having steam outlet openings arranged in the treatment chamber, characterized by a weighing device for weighing in each case one article of clothing with the transport hanger which is carrying said article of clothing, which weighing device is designed to separate the transport hanger, which is carrying the article of clothing, from the carrying hook of the conveyer in order to weigh the article of clothing and transport hanger which are briefly at a standstill, and to hang the transport hanger, which is carrying the weighed article of clothing, back on the carrying hook. Said tunnel finisher is characterized by a weighing device for weighing in each case one transport hanger with the article of clothing hanging thereon. The weighing device permits a brief decoupling of the transport hanger, with the article of clothing hanging thereon, which is presently to be weighed. In this way, the weighing can be carried out while the article of clothing and transport hanger are at a standstill, which leads to precise results. After the weighing, the transport hanger with the article of clothing hanging thereon is hooked back onto the carrying hook from the weighing device. The transport hanger with the article of clothing is preferably hooked back onto that carrying hook from which it was previously decoupled, specifically for the purpose of weighing. It is however also conceivable, after the weighing, for the transport hanger with the article of clothing to be hooked onto the next carrying hook, as a result of which a change of carrying hook takes place during the weighing process.

BRIEF DESCRIPTION OF THE DRAWINGS

Preferred exemplary embodiments of the invention are explained in more detail below on the basis of the drawing, in which.

DETAILED DESCRIPTION OF PREFERRED EMBODIMENTS

Figure 1:
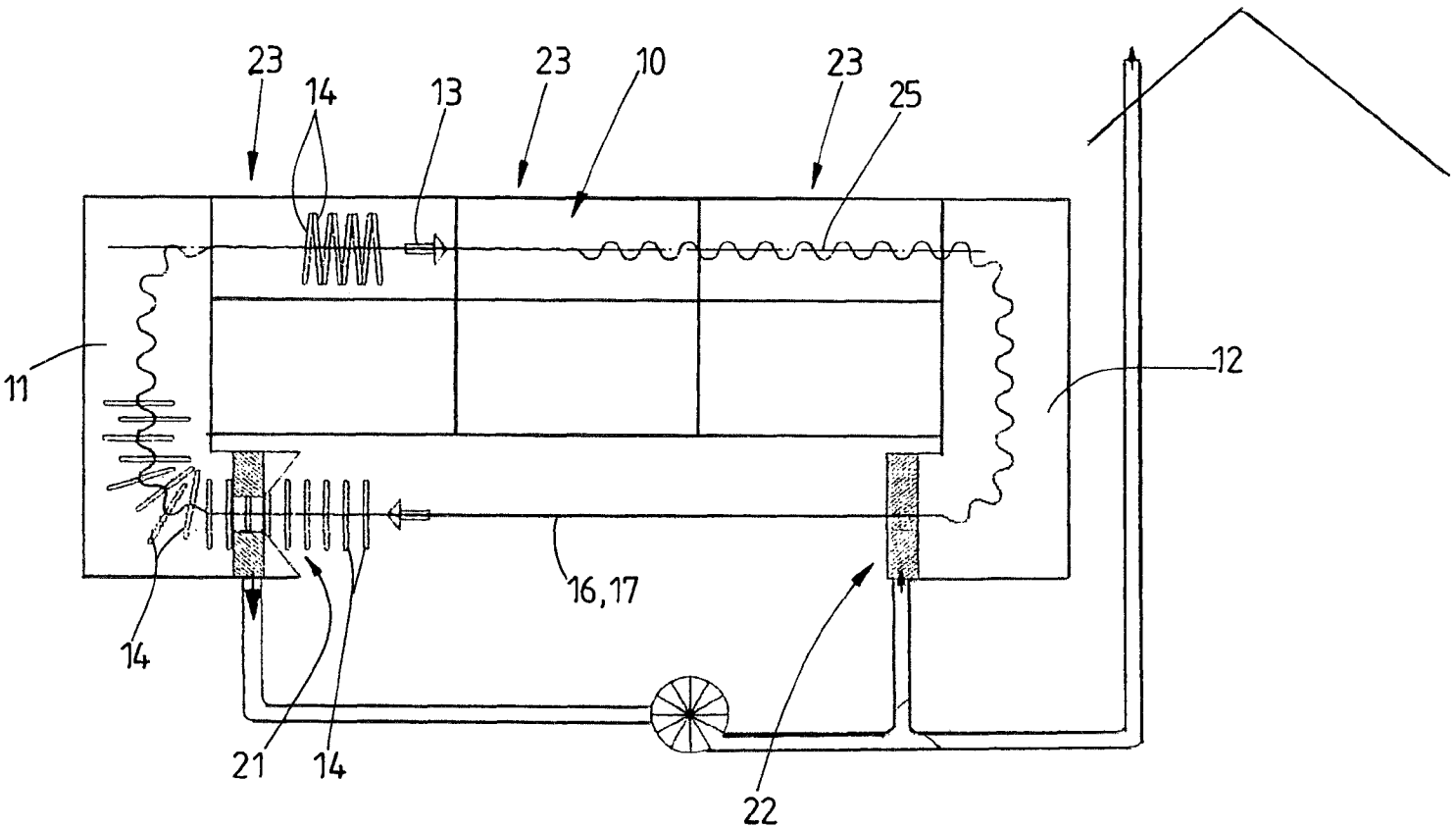
FIG. 1 shows a schematic plan view of a tunnel finisher with the profile of the conveyer path of a continuous conveyer through said tunnel finisher.

The tunnel finisher shown in the figures has a treatment chamber 10, an entry chamber 11 and an exit chamber 12. The articles of clothing 14, which are merely indicated in FIG. 1, and specifically if appropriate also articles of laundry, are transported through the tunnel finisher in the transport direction 13 indicated by an arrow while hanging from transport hangers 15. Here, the articles of clothing 14 are aligned transversely with respect to the transport direction 13. The continuous transport of the transport hangers 15 with the articles of clothing 14 hanging thereon through the tunnel finisher takes place by means of a continuous conveyer 16 which is arranged in the roof region of the tunnel finisher. The conveyer 16 has a continuous conveyer element which is driven in circulation and, in the exemplary embodiment shown, is embodied as a continuous conveyer chain 17. Carrying hooks 18 are fastened to the conveyer chain 17 at uniform spacings. The number of carrying hooks 18 is less than the number of chain links 19 of the conveyer chain 17. In this way, at least one chain link 19 without a carrying hook 18 is situated between two successive carrying hooks 18. Situated between successive carrying hooks 18 is always the same number of (empty) chain links 19, as a result of which all the spacings of the carrying hooks 18 on the conveyer chain 17 are identical. Each carrying hook 18 is designed for a transport hanger 15 to be hooked on, with a hanger hook 20 of the respective transport hanger 15 being hooked onto the carrying hook 18 in the exemplary embodiment shown.

The articles of clothing 14 hanging on the transport hangers 15 are transported through an entry opening 21 into the entry chamber 11 of the tunnel finisher. As viewed in the transport direction 13, the articles of clothing 14 pass from the entry chamber 11 into the subsequent treatment chamber 10. After the treatment chamber 10, the articles of clothing 14 are transported onward in the transport direction 13 through the exit chamber 12. The finished articles of clothing 14, hanging on the respective transport hanger 15, leave the tunnel finisher through an exit opening 22 at the end of the exit chamber 12. After the exit opening 22, the transport hangers 15 with the articles of clothing hanging thereon are separated from the carrying arms 18 of the conveyer 16 and are led away by means of a separate conveyer system, for example a lead-away path 55. The empty carrying hooks 18 on the conveyer chain 17 then pass again to the entry opening 21, where the transport hangers 15 with the articles of clothing 14 which are to be finished are hooked onto the carrying hooks 18. The conveyer chain 17 of the conveyer 16 is driven continuously in circulation, that is to say with the same transport speed. Here, the conveyer chain 17 with the carrying hooks 18 fastened thereto runs in a circuit through the tunnel finisher.

The treatment chamber 10 of the tunnel finisher shown here is formed from three modules 23 which are arranged in series in the transport direction 13. In the exemplary embodiment shown, all three modules 23 are of approximately identical design, and are above all of the same length. The invention is however not restricted to tunnel finishers with three modules 23. The invention is in fact also suitable for tunnel finishers with more than three and less than three modules 23. At least the first module 23 as viewed in the transport direction 13 is designed for impinging on the articles of clothing 14 with steam. In the exemplary embodiment shown, the two first modules 23 permit the steam impingement of the articles of clothing 14. That region of the treatment chamber 10 which permits a steam impingement of the articles of clothing 14 is referred to as the spray steam zone. Directly after the spray steam zone, that is to say in the rear region of the treatment chamber 10, drying and cooling of the articles of clothing 14 takes place.

The treatment chamber 10 of the tunnel finisher is provided at least in the region of the spray steam zone with steam outlet openings 24. The steam outlet openings 24 are situated in the roof region of the treatment chamber 10, specifically preferably below the conveyer 16. According to the invention, a discontinuous steam discharge takes place at the steam outlet openings 24. The articles of clothing 14 are in this way impinged on with steam in a pulsed fashion, by virtue of brief steam pulses being discharged from the steam outlet openings only at times. It is preferably provided that steam pulses are discharged from all the steam outlet openings 24 simultaneously, as a result of which the steam discharge from all the steam outlet openings 24 is also simultaneously interrupted. It is however also conceivable for steam to be discharged simultaneously only from selected groups of steam outlet openings 24, while no steam is discharged from the at least one group of other steam outlet openings 24. A brief discharge of steam from the one or other group of the steam outlet opening 24 therefore takes place in a manner offset in terms of time. The steam outlet openings 24 which are combined to form a group for uniform steam discharge can be distributed over the roof region of the treatment chamber 10 or can be arranged so as to be situated together. In the latter case, the steam discharge takes place in sections of the treatment chamber 10, with the individual sections being arranged in succession in the transport direction 13 in such a way that steam is discharged by degrees from the steam outlet openings 24 of the individual sections. As a result of the only brief, pulsed steam discharge from the different steam outlet openings 24, not only is steam saved, but said steam discharge also generates pulses which are imparted to the articles of clothing 14, and thereby cause movements between adjacent articles of clothing 14 which lead to periodic increases and decreases in size of the spacings between halves of adjacent articles of clothing 14, as a result of which the steam discharged from the steam outlet openings 24 can pass more effectively to the articles of clothing 14, specifically above all also to the lower regions thereof.

The steam outlet openings 24 are preferably embodied as steam outlet nozzles. This leads, in particular in the case of a discontinuous discharge of steam, to energy-laden steam pulses, which cause particularly intensive movements between adjacent articles of clothing 14, and lead to steam being saved.

It is also provided that the steam outlet openings 24 are arranged at different points with respect to the width of the treatment chamber 10. With regard to a vertical longitudinal central plane 25 of the treatment chamber 10, which also runs through the conveyer chain 17 of the conveyer 16, the spacing of the steam outlet openings 24 which are successive in the transport direction 13 varies. In the exemplary embodiment shown, the steam outlet openings 24 are arranged symmetrically with respect to the vertical longitudinal central plane 25 through the treatment chamber 10. In this way, the spacings of steam outlet openings 24 situated on opposite sides of the longitudinal central plane 25 with respect to the longitudinal central plane 25 are equally large. As viewed in the transport direction 13, the spacings of the steam outlet openings 24 from the longitudinal central plane 25 are increasingly larger. In the exemplary embodiment shown, the steam outlet openings 24 which are successive in the transport direction 13 are arranged on straight lines 26 which run antiparallel with respect to the vertical longitudinal central plane 25. As viewed in the transport direction 13, the spacing of each line 26 on both sides of the longitudinal central axis 25 relative to the latter increases continuously, so that the lines 26 on opposite sides of the longitudinal central plane 25 diverge slightly as viewed in the transport direction 13. The spacings of the steam outlet openings 24 on each line 26 are approximately identical.

Figure 11:
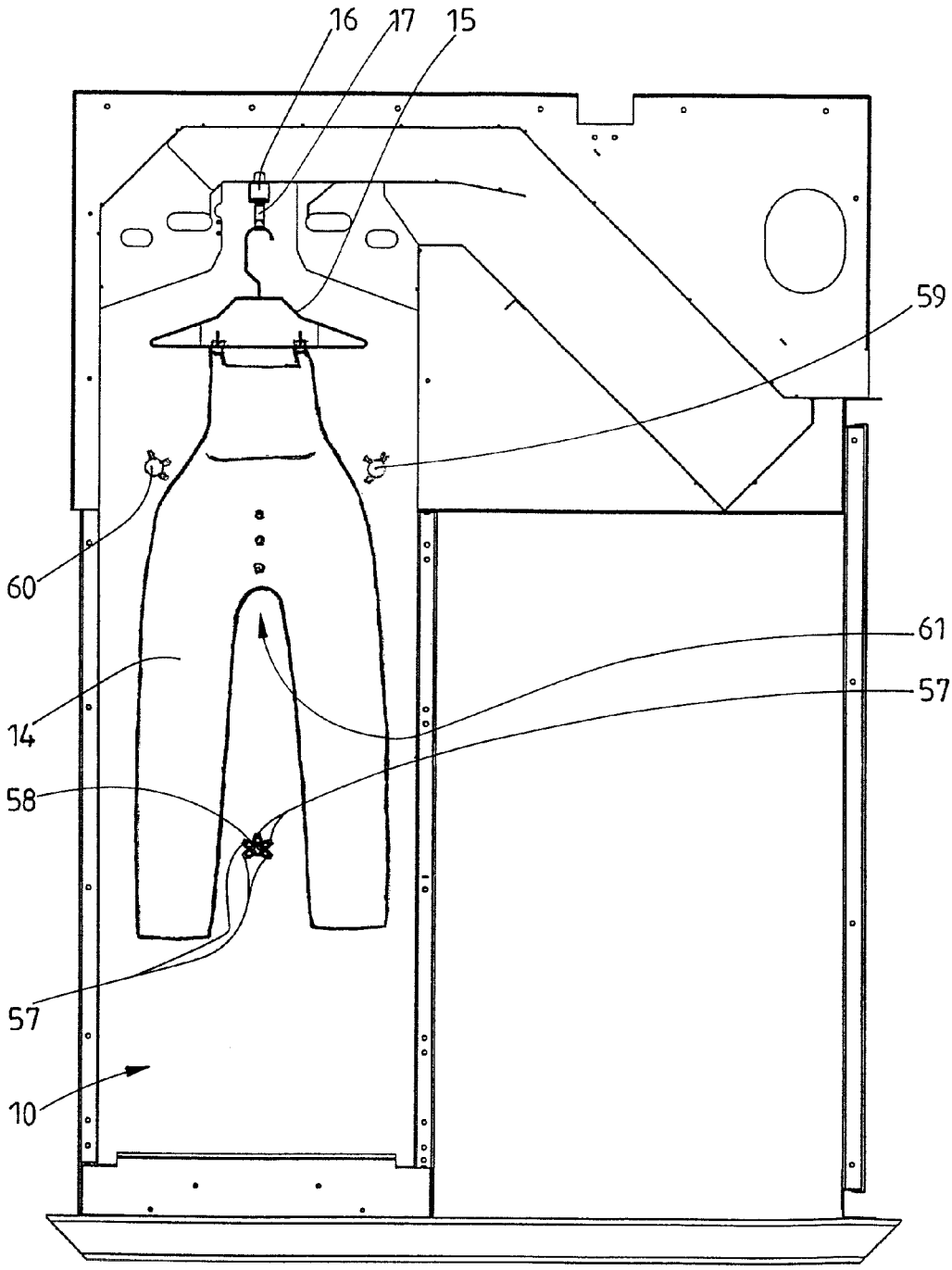
FIG. 11 shows a cross section through a steam zone of the tunnel finisher with a pair of trousers.
Figure 12:
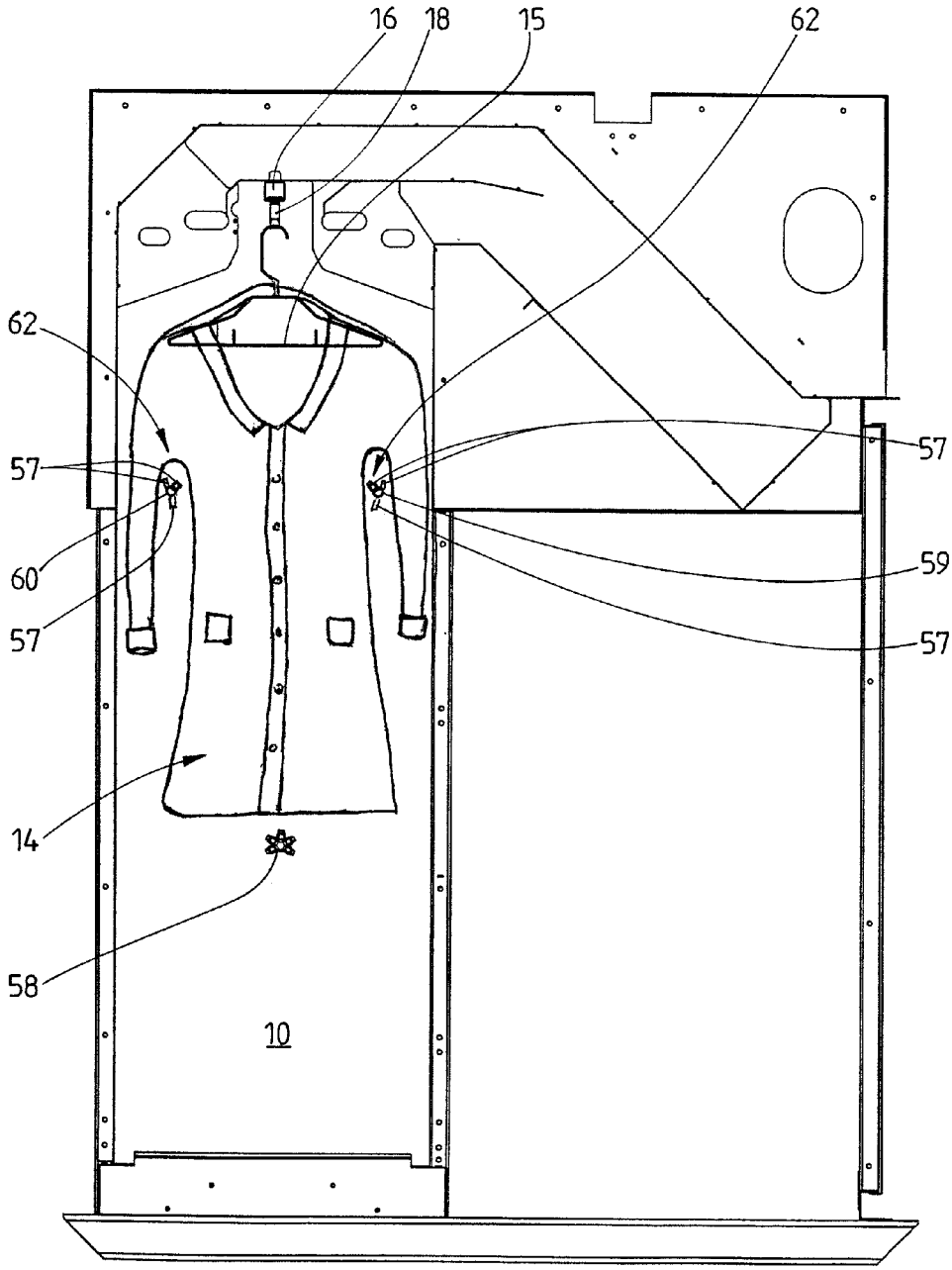
FIG. 12 shows a cross section as per FIG. 11, with a blouse.

FIGS. 11 and 12 show the arrangement of further steam outlet openings 57 in the treatment chamber 10. The steam outlet openings 57 are assigned to tubes 58, 59 and 60 which run horizontally in the longitudinal direction of the treatment chamber 10. The steam outlet openings 57 can be steam nozzles or else simple bores in the tubes 58, 59 and 60. A central, lower tube 58 is provided for articles of clothing 14 which have trouser legs, for example trousers, overalls, dungarees or the like (FIG. 11). The tube 58 is arranged centrally in the treatment chamber 10, specifically in such a way as to extend in the longitudinal direction of the treatment chamber 10 and to be situated with a spacing below the crotch region 61 of the trousers or of another article of clothing 14 which has legs. The tube 58 is arranged at such a height of the treatment chamber 10 that other articles of clothing 14 which do not have legs, for example blouses (FIG. 12), run along above the tube 58.

The tube 58 is assigned five rows of steam outlet openings 57 which are arranged in succession in the longitudinal direction of the treatment chamber 10 with uniform spacings and which are aligned in different directions. A central row of steam outlet openings 57 is aligned vertically upward into the crotch region 61. The two rows of steam outlet openings 57 which are situated adjacent thereto and point obliquely upward serve for the steam impingement of further hard to dry parts of the article of clothing 14 which has legs, for example pockets. The two lower rows of steam outlet openings 57, which are aligned such that the steam jets point downward, obliquely to the side, serve for drying and smoothing the legs of the article of clothing 14.

The two upper tubes 59 and 60 are arranged on opposite sides of the torso of an article of clothing 14 which has sleeves, specifically in each case a short distance below the armpit regions 62. Each tube 59 and 60 has three rows with successive outlet openings 57 which are aligned obliquely upward and obliquely downward in the direction of the torso part. The spacing of the tubes 59 and 60 which are assigned to the armpit regions 62 is selected such that the waistband region of an article of clothing 14 which has legs can be transported through between them unhindered (FIG. 11).

The steam outlet openings 57 from the tubes 58, 59 and 60 can be supplied with steam in a continuous or discontinuous fashion. For finishing articles of clothing 14 which have legs, it is generally sufficient if only the lower tube 58, which is assigned to the crotch region 61, is supplied with steam, and steam for treating the article of clothing 14 which has legs is therefore discharged only from the steam outlet openings 57 of the tube 58. For treating blouses or other articles of clothing 14 which do not have legs, preferably only the steam outlet openings 57 of the two upper tubes 59 and 60 in the armpit regions 62 are impinged on with steam. It is however also conceivable, in particular during mixed operation of the tunnel finisher with articles of clothing 14 of different types in succession, for the steam outlet openings 57 of all of the tubes 58, 59 to be supplied with steam.

In the tunnel finisher shown here, four horizontal tubes 27, 28 are arranged above the conveyer 16 in the roof region of the treatment chamber, specifically in particular in the spray steam zone, specifically two tubes 27, 28 on each side of the longitudinal central plane 25. The two tubes 27, 28 on each side of the longitudinal central plane 25 run parallel to one another. The arrangement of the tubes 27, 28 on both sides of the longitudinal central plane 25 is mirror-symmetrical. Provided in the tubes 27 and 28, with uniform spacings, are steam outlet openings 24 which are preferably aligned vertically downward and are embodied in particular as steam outlet nozzles. As a result of the described arrangement of the steam outlet openings 24 with a spacing, which decreases in the transport direction 13, from the longitudinal central plane 25 (FIG. 3), as the articles of clothing 14 are transported through the spray steam zone of the treatment chamber 10, other parts of the articles of clothing 14 are constantly impinged on, specifically sprayed, with steam. In this way, the in particular pulsed, discontinuous steam impingement of the articles of clothing 14 according to the invention is not damaging.

In addition, it is provided according to the invention that the steam outlet openings 24 on one side of the longitudinal central plane 25 are offset with respect to the steam outlet openings 24 on the opposite side of the longitudinal central plane 25. Said offset can fundamentally be arbitrary. In the exemplary embodiment shown, the offset is half of the spacing between two successive steam outlet openings 24. Since the steam outlet openings on all the lines 26 have the same spacing to one another, all of the steam outlet openings on one side of the longitudinal central plane 25 are therefore situated "in the gaps" between in each case two steam outlet openings 24 of the opposite side of the longitudinal central plane 25.

Figure 3:
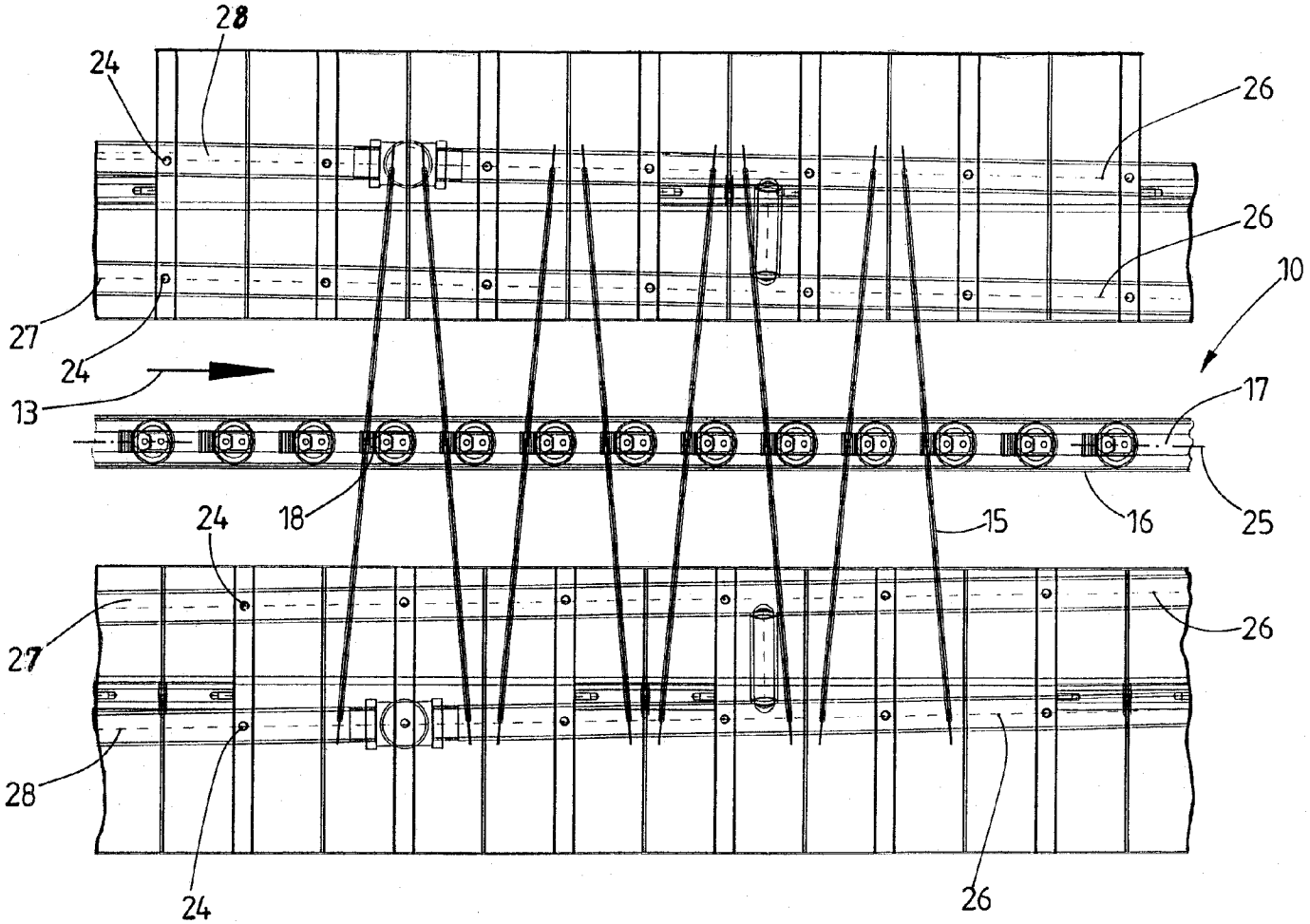
FIG. 3 shows a view from below toward empty transport hangers and steam outlet openings in the treatment chamber of the tunnel finisher.
Figure 4:
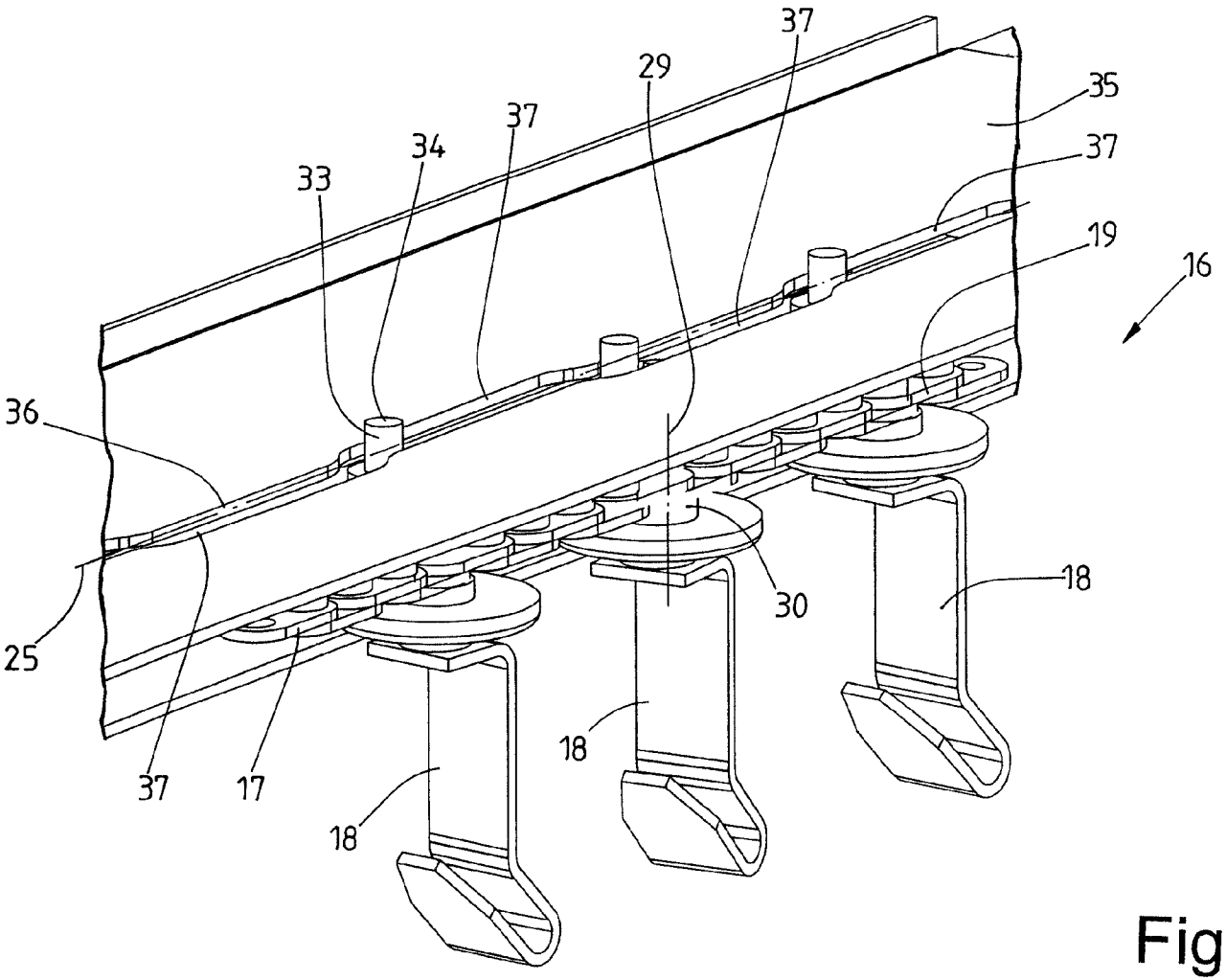
FIG. 4 shows a perspective view of a section of the conveyer through the tunnel finisher.
Figure 5:
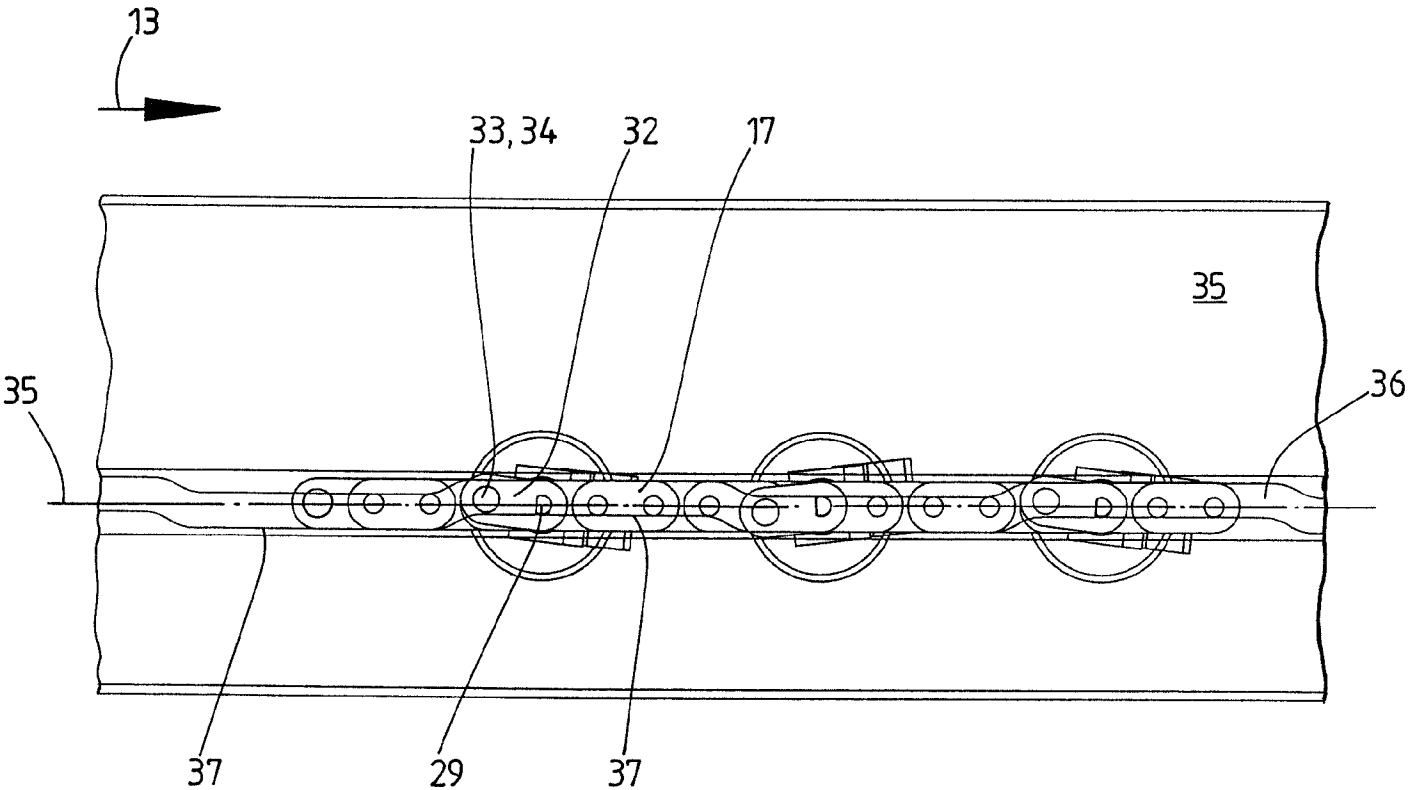
FIG. 5 shows a plan view of the conveyer of FIG. 4.
Figure 6:
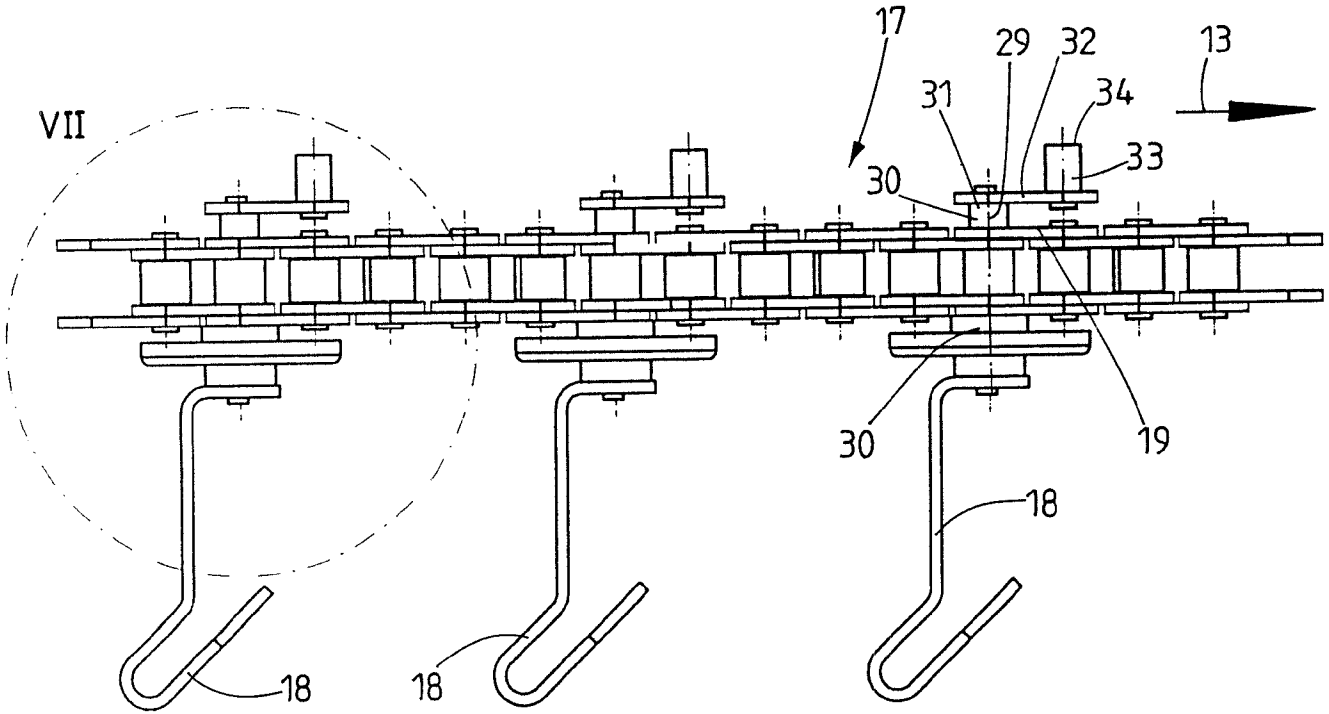
FIG. 6 shows a side view of a conveyer chain of the conveyer.
Figure 7:
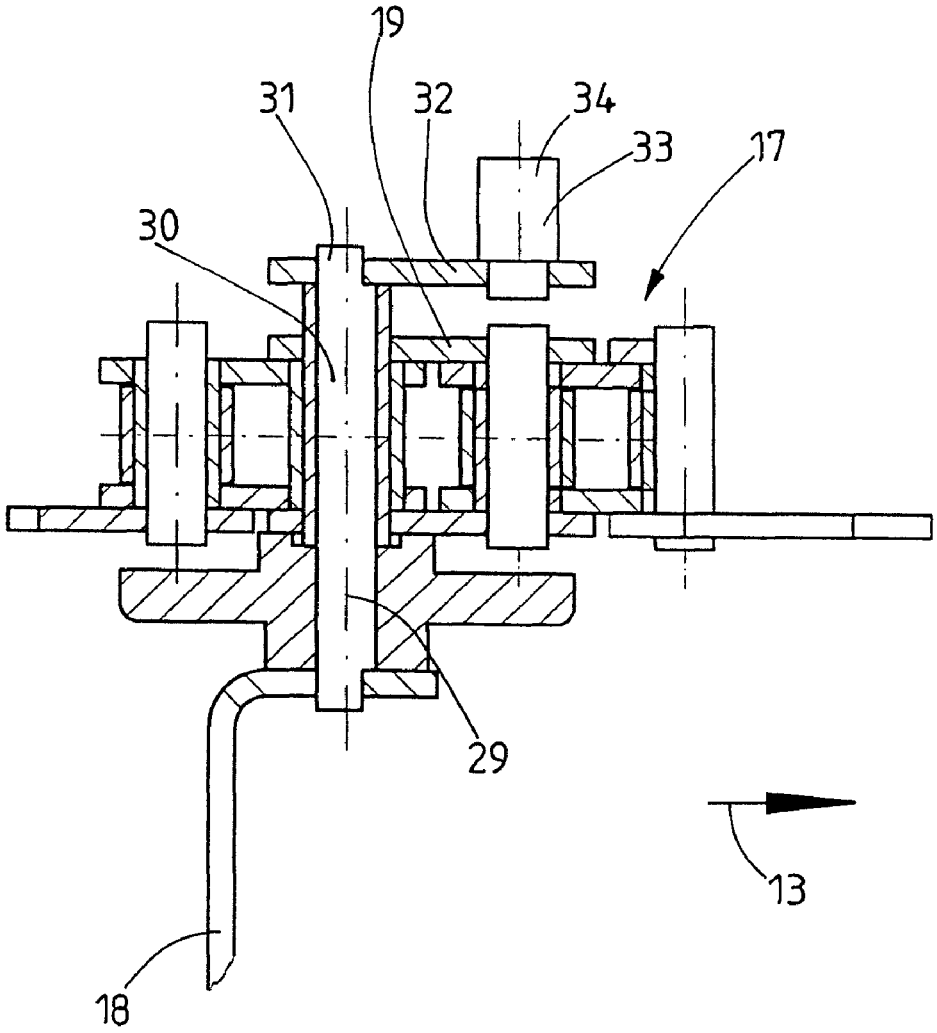
FIG. 7 shows an enlarged detail VII from FIG. 6.
Figure 8:
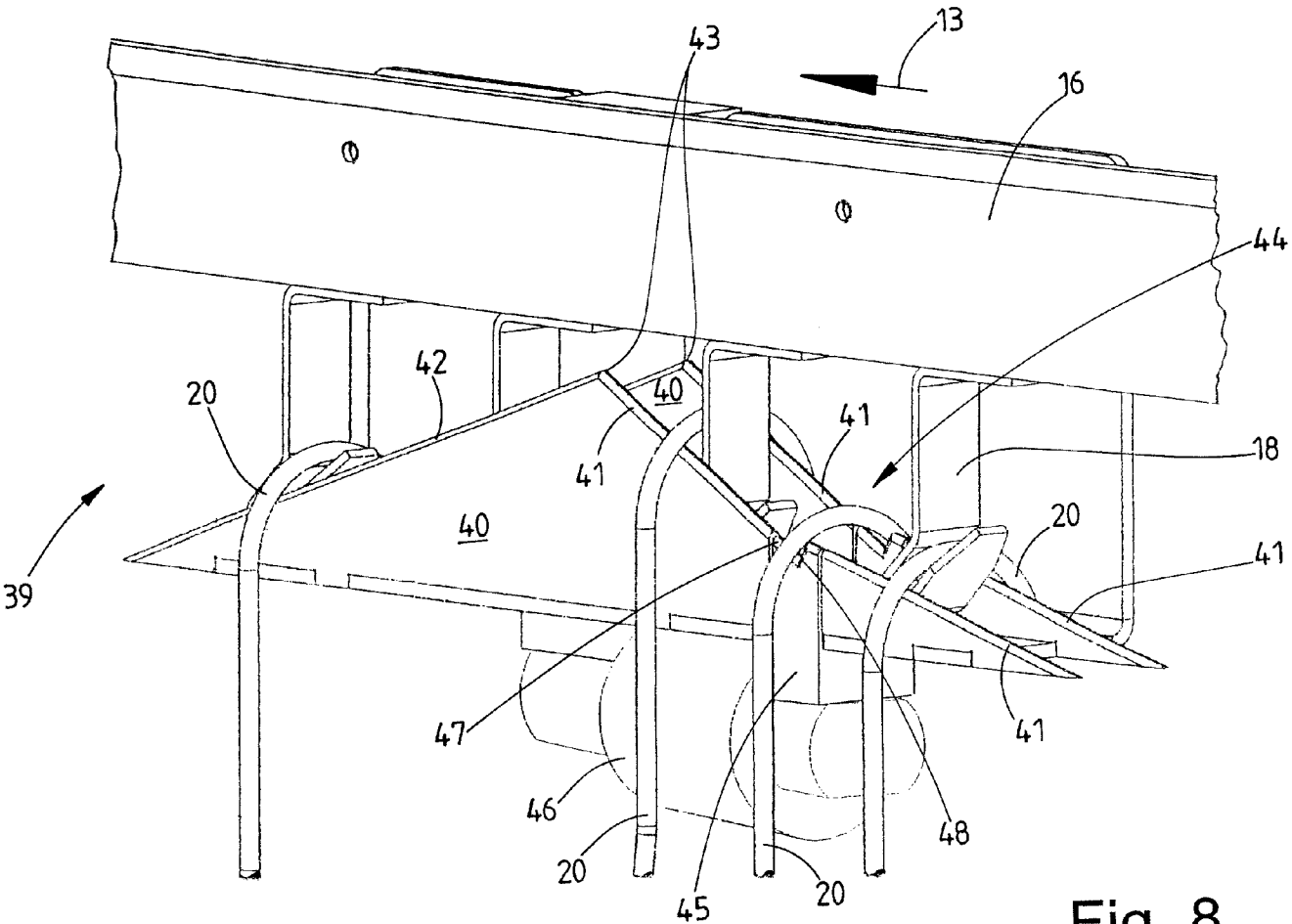
FIG. 8 shows a schematic perspective illustration of a weighing device.

According to the invention, the steam outlet openings 24 on each line 26 have a spacing which is coordinated with the spacing of the carrying hooks 18 and the conveyer chain 17. Accordingly, the spacing between two steam outlet openings 24 is double the spacing between in each case two adjacent carrying hooks 18. Because the steam outlet openings 24 on one side of the longitudinal central plane 25 are situated in the gaps with respect to the steam outlet openings on the other side of the longitudinal central plane 25, each carrying hook 18 is assigned at least one steam outlet opening 24, but alternately on different sides of the longitudinal central plane 25. The result is that when at least one steam outlet opening 24 on one side of the longitudinal central plane 25 is situated between two adjacent transport hangers 15 with articles of clothing 14 hanging thereon, steam is briefly discharged from the steam outlet opening 24. The steam pulse or steam impulse on the relevant side of the longitudinal central plane 25 then moves apart two adjacent transport hangers 15 with the articles of clothing 14 hanging thereon (FIG. 3). Here, the transport hangers 15, with the articles of clothing 14 hanging thereon, on the opposite side of the longitudinal central plane 25 are moved together (FIG. 3). In this way, in each case two adjacent transport hangers 15 with the articles of clothing 14 hanging thereon assume a type of V-shaped formation relative to one another, with said V-shaped formation of two adjacent transport hangers 15 alternating continuously as viewed in the transport direction 13, so that the spacing of one half of adjacent articles of clothing 14 with respect to the vertical longitudinal central plane 25 varies alternately, specifically becomes alternately larger and smaller. In this way, while being transported onward through the treatment chamber, in particular the spray steam zone, the articles of clothing 14 are rotated or twisted about a vertical axis which lies on the longitudinal central plane 25. A constant pivoting of the articles of clothing 14 is therefore generated while the latter are transported in the transport direction 13 through the treatment chamber 10.

While the twisting or continued pivoting of the articles of clothing 14 about a vertical central axis pneumatically takes place as a result of the offset of the steam outlet openings 24 on opposite sides of the longitudinal central plane 25, in such a way that said steam outlet openings 24 are situated "in the gaps", in the tunnel finisher shown, a mechanical rotation, in opposite directions, of the transport hangers 15 with the article of clothing 14 additionally takes place about a vertical central axis, which runs through the longitudinal central plane 25 of the treatment chamber 10, of the articles of clothing 14, which central axis is preferably situated approximately on the axis of the hanger hook 20 of the respective transport hanger 15. In order to rotate the transport hangers with articles of clothing 14 hanging thereon, the carrying hooks 18 are also rotatable below the conveyer chain 17, specifically about a rotational axis which runs approximately through the carrying hook 18 and the hanger hook 20 of the respective transport hanger 15. In order that the carrying hook 18 is rotatable relative to the conveyer chain 17, each carrying hook 18 is rotatable about a joint axis 29 for the moveable connection of adjacent chain links 19 of the conveyer chain 17. Accordingly, the conveyer chain 17 is arranged in the tunnel finisher in such a way that the joint axes 29 for connecting the chain links 29 run vertically.

Figure 2:
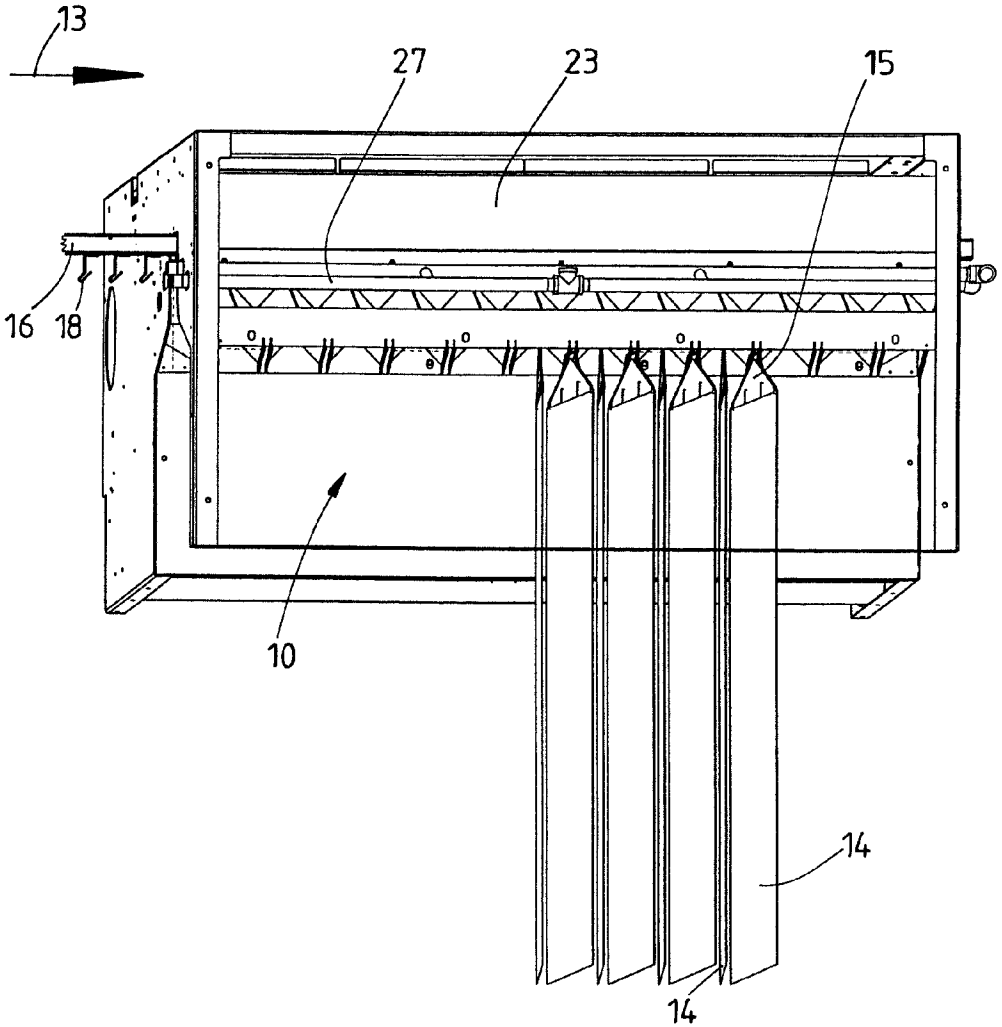
FIG. 2 shows a perspective view of a roof part of the tunnel finisher.

An upper cylinder projection 30 of the carrying hook 18 is guided through the articulated connecting point between two adjacent chain links 19 and projects upward with a free end 31 slightly beyond the conveyer chain 17. Fixedly fastened to said free end 31 of the cylinder projection 30 is a lug 32 which extends over a chain link 19, which lug 32 has, at the opposite end, an upwardly projecting guide pin 33. The guide pin 33 runs parallel to the cylinder projection 30. The guide pin 33 engages with its free end 34 into a positionally fixed guide above the conveyer chain 17. In the exemplary embodiment shown, the guide is embodied as a narrow plate 35 which extends in the transport direction 13 and in which is arranged a longitudinal slot 36 for the engagement of the free end 34 of the guide pin 33. At least in the region of the spray steam zone of the treatment chamber 10, the longitudinal slot 36 has successive sections 37 on opposite sides of the conveyer chain 17 which passes through centrally below the plate 35. Arranged between said sections 37, which run parallel to the center of the conveyer chain 17, are obliquely-aligned transition sections for the connection of the sections 37 on the one or other side of the center of the conveyer chain 17. As the carrying hook 18 which is rotatably fastened to the conveyer chain 17 moves onward in the transport direction 13, the guide pins 33 of the carrying hooks 18 pass alternately into a section 37 on the one or other side of the conveyer chain 17. As a result, the guide pins 33 pivot the lug 32, as a result of which the cylinder projection 30 with the carrying hook 18 fastened below it is rotated about its vertical rotational axis. Here, the sections 37 are dimensioned in terms of their length and the spacing from the center of the conveyer chain 17 such that the carrying hooks 18 periodically pivot or rotate the transport hangers 15, with the articles of clothing 14 hanging thereon, in opposite directions, thereby generating the alternating V-shaped configuration of successive transport hangers 15 with articles of clothing 14 hanging thereon (FIG. 2).

The arrangement of the sections 37 of the slot 36 of the plate 35 is coordinated with the steam outlet openings 24. The sections 37 are assigned to the steam outlet openings 24, specifically in such a way that said sections 37 are always situated on the side adjacent to the conveyer chain 17 where steam outlet openings 24 are also present. The length of each section 37 corresponds approximately to the pitch between two successive carrying hooks 18. In this way, the pneumatic and the mechanical rotation of the transport hangers 15 with the articles of clothing 14 assist one another. The transport hangers 15 with the articles of clothing 14 are rotated synchronously, mechanically and pneumatically in opposite directions into alternating V-shaped configurations (FIG. 2).

It is conceivable for the transport hangers 15 with the articles of clothing 14 to be rotated only pneumatically or only mechanically. The invention is therefore not restricted to the tunnel finisher shown having both mechanical and also pneumatic rotation of the transport hangers 15 with the articles of clothing 14.

Figure 10:
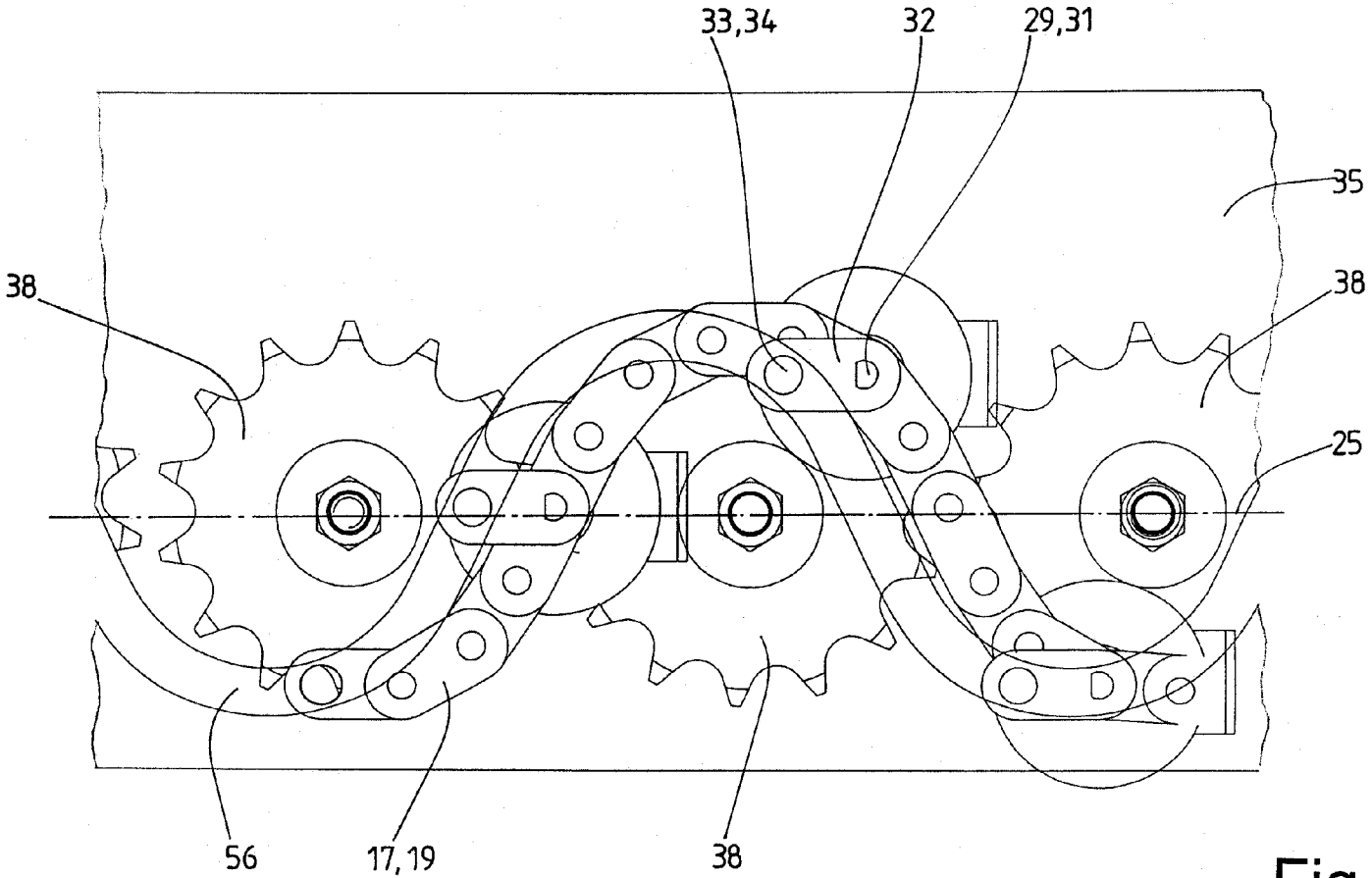
FIG. 10 shows a plan view of a sinuous-line-shaped part of the conveyer.

As can be seen in particular from FIG. 1, the conveyer 16 of the tunnel finisher shown here has a sinuous-line-shaped or sinusoidal-line-shaped profile primarily in the entry chamber 11 and the exit chamber 12, but also in the final module 23 as viewed in the transport direction 13, and the rear half of the central module 23. For this purpose, sprockets 38 which are arranged in succession with spacing are arranged on opposite sides of the conveyer chain 17. The sprockets 38 are freely rotatable about vertical rotational axes which lie on the longitudinal central plane 25 of the treatment chamber 10, entry chamber 11 and exit chamber 12. The sprockets 38 are arranged in series with such a spacing that the conveyer chain 17 is guided alternately around opposite peripheral halves of the sprockets 38 which are successive in the transport direction 13 (FIG. 10).

The guide pins 33, which project upward beyond the conveyer chain 17, on the lugs 32 for rotating the carrying hooks 18 are in turn guided in the longitudinal slot 36 of the plate 35 above the conveyer chain 17. In the region of the sinuous-line-shaped conveyer chain 17 which runs around the sprockets 38, the longitudinal slot 36 in the plate 35 likewise has a sinuous-line-shaped profile. The sinuous-line-shaped profile of the longitudinal slot 36 in the plate 35 has the same configuration of the sinuous-line-shaped profile of the conveyer chain 17 about the sprockets 38. The sinuous-line-shaped profile of the conveyer chain 17 however slightly leads the sinuous-line-shaped profile of the longitudinal slot 36, specifically by the spacing of the guide pin 33 on the lug 32 to the joint axis 29 for the connection of adjacent chain links 19 of the conveyer chain 17 (FIG. 10). During the sinuous-line-shaped continued movement of the conveyer chain 17 in the transport direction 13, the guide pins 33 which slide along on the longitudinal slot 36, which runs in the shape of a sinuous line, rotate the carrying hooks 18 and therefore the transport hangers 15 with the articles of clothing 14 hanging thereon in such a way that, in the region of the conveyer path, the transport hangers with the articles of clothing 14 hanging thereon always run parallel to one another, transversely with respect to the transport direction 13. The transport hangers 15 with the articles of clothing 14 hanging thereon however do not overlap completely, but are rather offset transversely with respect to the transport direction 13, so that the opposite ends of the transport hangers 15 are also situated on sinuous lines. In this way, edge regions of the successive articles of clothing project outward with respect to one another, by virtue of said edge regions being free and better accessible for more uniform heating or cooling and drying.

In the tunnel finisher shown here, the individual articles of clothing 14 are in each case weighed with the transport hanger 15 on which they hang. This takes place by means of a weighing device 39 before the tunnel finisher, in particular before the entry opening 21 thereof. The weighing device 39 has two parallel triangular plates 40. The plates 40 are arranged so as to be positionally fixed below the conveyer chain 17, specifically in such a way that the carrying hooks 18 which are fastened transversely with respect to the transport direction 13 below the conveyer chain 17 can run through between the plates 40. The oppositely-inclined cathetuses 41 and 42, which are situated at the top, of the plates 40 are aligned such that the cathetus 41, which is situated forward in the transport direction 13, rises up to the highest apex 43. The cathetus 42, which follows in the transport direction, of each plate 40 subsequently falls away. When passing through between the plates 40, the carrying hooks 18 initially dip to an increasing degree between the cathetuses 41 of the plates 40, and after passing through the apex 43, the carrying hooks 18 gradually emerge again between the cathetuses 42 of the plates 40.

In the regions of the rising cathetuses 41, the plates 40 have recesses 44. Said recess 44 is partially filled by a U-shaped weighing support 45. The weighing support 45 rests on a scale 46, which is for example embodied as an electronic scale. The cathetuses 41 are divided by the recess 44 into a front and rear cathetus section as viewed in the transport direction 13. The weighing support 45 in the recess 44 has upper edges, by means of which the cathetus sections of the cathetuses 42 are bypassed, and a step 47 with an approximately vertical step section 48.

With the above-described weighing device 39, the weighing process of the respective article of clothing 14, with the transport hanger 15 and article of clothing 14 which carries it, takes place as follows:

As the transport hanger 15, with an article of clothing 14 hanging thereon, moves along in the transport direction 13 at the weighing device 39, the respective carrying hook 18 passes between the plates 40. Here, the hanger hook 20 of the respective transport hanger 15 runs on the forward region in the transport direction 13 of the rising cathetuses 41 of the plates 40. Once the carrying hook 18 with the transport hanger 15 hanging thereon has passed said first region of the cathetuses 41, the transport hanger 15 passes into the region of the weighing support 45. Here, or shortly after this, the carrying hook 18 dips so far between the cathetuses 41 that the hanger hook 20 is decoupled from the carrying hook 18. The transport hanger 15 then slides back slightly until it comes into contact with the step section 48 of the step 47 of the weighing support 45. The transport hanger 15, with the article of clothing 14, which is now decoupled from the conveyer 16 is then for a short time not transported onward. During said standstill of the transport hanger 15 with the articles of clothing 14, the weighing of the transport hanger 15 with the article of clothing 14 takes place with the scale 46 assigned to the weighing support 45. From the result of the weighing process, the weight of the article of clothing 14 can be calculated by subtracting the known weight of the transport hanger 15. After the conclusion of the weighing process, the front side of the following carrying hook 18 comes into contact with the hanger hook 20, as a result of which the latter is moved by the following carrying hook 18 out of the region of the weighing support 45 and is moved over the following rising sections of the cathetuses 41 and over the apex 43. The transport hanger 15 with the hanger hook 20 then slides down the falling cathetuses 42 until it comes into contact in front of the carrying hook 18 from which the transport hanger 15 was previously decoupled. As the hanger hook 20 slides further down the falling cathetuses 42 of the plates 40, the hanger hook 20 of the transport hanger 15 comes into contact again with the carrying hook 18 which, after passing the weighing device 39, transports the transport hanger 15, with the article of clothing 14 hanging thereon, onward in the transport direction 13. This is the same carrying hook 18 from which the transport hanger 15 was unhooked before weighing.

Figure 9:
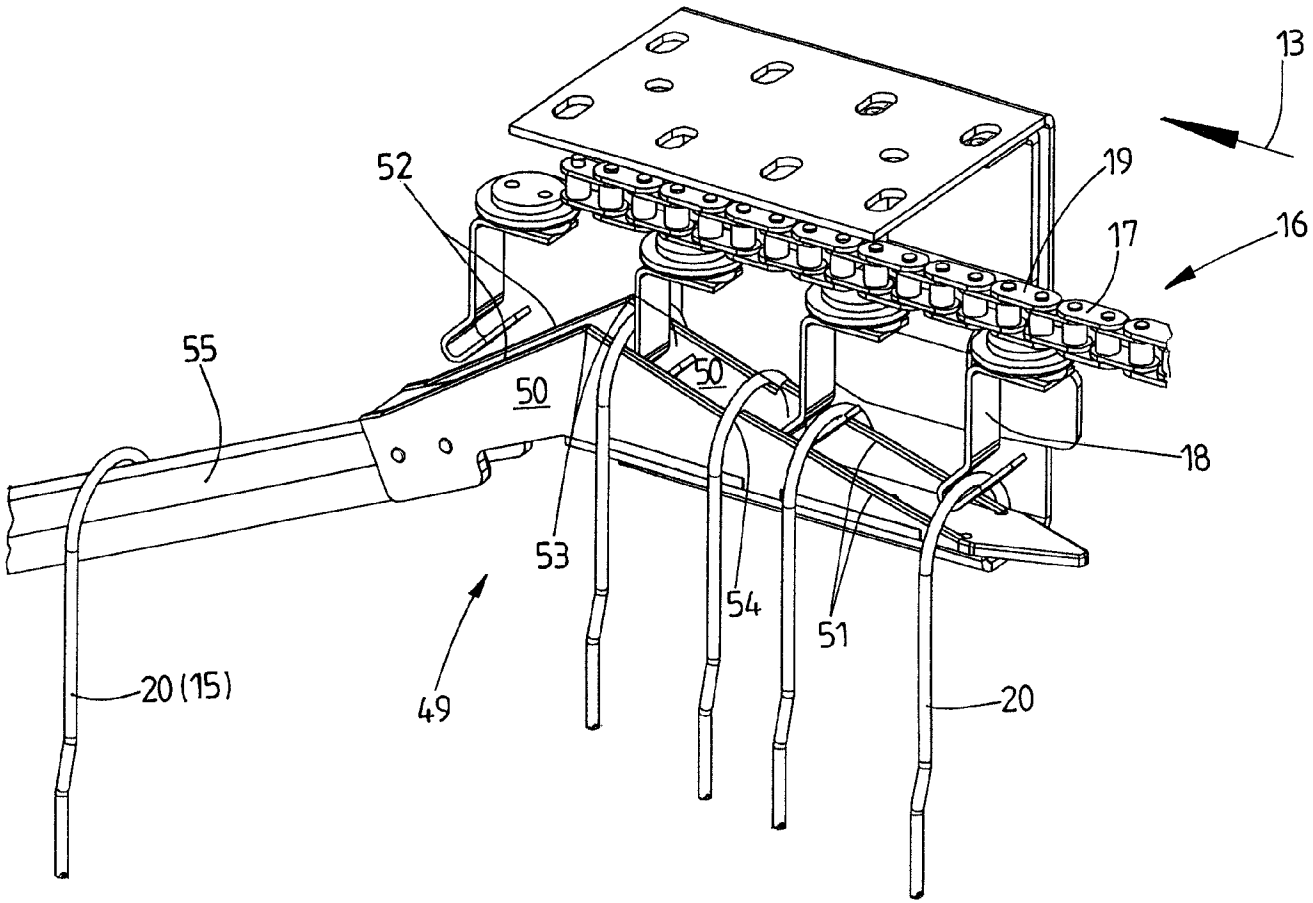
FIG. 9 shows a perspective view of a hanger throw-off device.

FIG. 9 shows a decoupling device 49 which is situated at the end of the tunnel finisher and which preferably follows the exit opening 22 of the exit chamber 12 in the transport direction 13. The decoupling device 49 operates in principle in the manner of the above-described weighing device 39. Accordingly, the decoupling device 49 also has two parallel plates 50, between which the carrying hooks 18 can pass. The triangular upper sides of the plates 50 have cathetuses 51 which rise in the transport direction 13, and falling cathetuses 52 which follow in the transport direction 13. Situated in the transition between the cathetuses 51 and 52 is an apex 53 which is situated at the highest point of the plates 50. The rising cathetuses are divided by a shoulder 54 into a front and a rear cathetus section.

As a transport hanger 15 with an article of clothing 14 hanging thereon moves along on the decoupling device 49, the hanger hook 20 passes onto the rising cathetuses 51. Here, the transport hanger 15 with the article of clothing 14 hanging thereon is raised, while the lower part of the carrying hook 18 dips into the intermediate space between the plates 50. Here the hanger hook 20 is released from the carrying hook 18 shortly after the shoulder 54 as viewed in the transport direction 13. The transport hanger 15 slides back only slightly counter to the transport direction 13 until its hanger hook 20 abuts against the shoulder 54 and is stopped here. As a result of the contact of the hanger hook 20 in front of the following carrying hook 18, the transport hanger 15 is now pushed up the obliquely rising cathetuses 51 and over the apex 53. From here, the transport hanger 15 with the article of clothing 14 hanging thereon slides down the falling cathetuses 52 onto an adjoining, downwardly-directed lead-away path 55, which in the simplest case is a rail or a tube. The empty carrying hook 18 is moved onward along the conveyer chain 17 on the conveyer path to the entry opening 21 of the tunnel finisher, where a new transport hanger 15 with an article of clothing 14 hanging thereon, which is to be finished, is hung on the carrying hook 18.

The above-described weighing device 39 and also the decoupling device 49 are suitable not only for continuous conveyers on tunnel finishers but also for other continuous conveyers in the field of laundry, for example for supplying articles of laundry to folding machines.

List of reference symbols

| | | | |
|---|---|---|---|
| 10 | Treatment chamber | 37 | Section |
| 11 | Entry chamber | 38 | Sprocket |
| 12 | Exit chamber | 39 | Weighing device |
| 13 | Transport direction | 40 | Plate |
| 14 | Article of clothing | 41 | Cathetus |
| 15 | Transport hanger | 42 | Cathetus |
| 16 | Conveyer | 43 | Apex |
| 17 | Conveyer chain | 44 | Recess |
| 18 | Carrying hook | 45 | Weighing support |
| 19 | Chain link | 46 | Scale |

-continued

| List of reference symbols | | | |
|---|---|---|---|
| 20 | Hanger hook | 47 | Step |
| 21 | Entry opening | 48 | Step section |
| 22 | Exit opening | 49 | Decoupling device |
| 23 | Module | 50 | Plate |
| 24 | Steam outlet opening | 51 | Cathetus |
| 25 | Longitudinal central plane | 52 | Cathetus |
| 26 | Line | 53 | Apex |
| 27 | Tube | 54 | Shoulder |
| 28 | Tube | 55 | Lead-away path |
| 29 | Joint axis | 56 | Sinuous-line-shaped slot |
| 30 | Cylinder projection | 57 | Steam outlet opening |
| 31 | End | 58 | Tube |
| 32 | Lug | 59 | Tube |
| 33 | Guide pin | 60 | Tube |
| 34 | Free end | 61 | Crotch region |
| 35 | Plate | 62 | Armpit region |
| 36 | Longitudinal slot | | |

What is claimed is:

1. A method for smoothing articles of clothing (14) in a tunnel finisher, comprising the steps of:

hanging the articles of clothing (14) on transport hangers (15);

transporting the articles of clothing (14) in a transport direction (13) longitudinally through a treatment chamber (10) of the tunnel finisher;

spraying the articles of clothing with steam;

at least partially enlarging at times the spacing between adjacent articles of clothing (14); and rotating the transport hangers (15), with the articles of clothing (14) hanging thereon, in opposite directions in pairs in such a way that ends of two adjacent transport hangers (15) have a smaller spacing on one side of a vertical longitudinal central plane (25) of the treatment chamber (10) than on an opposite side of the longitudinal central plane (25).

2. The method as claimed in claim 1, wherein the transport hangers (15) with the articles of clothing (14) hanging thereon are rotated about vertical central axes at least in a spray steam zone while passing through the treatment chamber (10).

3. The method as claimed in claim 1, wherein the transport hangers (15) with the articles of clothing (14) hanging thereon are rotated mechanically.

4. The method as claimed in claim 1, wherein the transport hangers (15) with the articles of clothing hanging thereon are rotated hydraulically by means of the impingement of the articles of clothing (14) with steam.

5. A method for smoothing articles of clothing (14) in a tunnel finisher, comprising the steps of:

hanging the articles of clothing (14) on transport hangers (15);

transporting the articles of clothing (14) in a transport direction (13) longitudinally through a treatment chamber (10) of the tunnel finisher;

spraying the articles of clothing with steam;

at least partially enlarging at times the spacing between adjacent articles of clothing (14); and rotating the transport hangers (15) with the articles of clothing (14) hanging thereon, while being transported further along the transport direction (13), in opposite directions in such a way that spacings between ends of in each case two successive transport hangers (15) are alternately increased and decreased in size.

6. The method as claimed in claim 5, wherein the transport hangers (15) with the articles of clothing (14) hanging thereon are rotated about vertical central axes at least in a spray steam zone while passing through the treatment chamber (10).

7. The method as claimed in claim 5, wherein the transport hangers (15) with the articles of clothing (14) hanging thereon are rotated mechanically.

8. The method as claimed in claim 5, wherein the transport hangers (15) with the articles of clothing hanging thereon are rotated hydraulically by means of the impingement of the articles of clothing (14) with steam.

* * * * *